US011514826B2

(12) United States Patent
Kim et al.

(10) Patent No.: US 11,514,826 B2
(45) Date of Patent: Nov. 29, 2022

(54) MAGNETIC FLUID DISPLAY

(71) Applicant: CK MATERIALS LAB CO., LTD., Seoul (KR)

(72) Inventors: Hyeong Jun Kim, Seoul (KR); Jong Hun Lee, Seoul (KR); Min Kyu Choi, Seoul (KR)

(73) Assignee: CK Materials LAB Co., Ltd., Seoul (KR)

( * ) Notice: Subject to any disclaimer, the term of this patent is extended or adjusted under 35 U.S.C. 154(b) by 0 days.

(21) Appl. No.: 17/489,823

(22) Filed: Sep. 30, 2021

(65) Prior Publication Data

US 2022/0020300 A1 Jan. 20, 2022

Related U.S. Application Data

(62) Division of application No. 16/641,643, filed as application No. PCT/KR2018/007023 on Jun. 21, 2018, now Pat. No. 11,170,672.

(30) Foreign Application Priority Data

Aug. 23, 2017 (KR) ..... 10-2017-0106872

(51) Int. Cl.
*G09F 9/37* (2006.01)
*G09F 27/00* (2006.01)

(52) U.S. Cl.
CPC ..... *G09F 9/37* (2013.01); *G09F 27/00* (2013.01)

(58) Field of Classification Search
CPC ..... G09F 9/37; G09F 9/375; G09F 27/00
See application file for complete search history.

(56) References Cited

U.S. PATENT DOCUMENTS 3,648,269 A * 3/1972 Rosenweig ..... G02F 1/091 40/449
4,536,428 A * 8/1985 Murata ..... B43L 1/008 434/152

(Continued)

FOREIGN PATENT DOCUMENTS

CN 204213830 U 3/2015
CN 206097797 U 4/2017

(Continued)

OTHER PUBLICATIONS

The magnetic fluid that can dance in line exhibition of China Science and Technology Museum: htts://v.qq.com/x/page/r0353jauknt.html.

*Primary Examiner* — Gary C Hoge
(74) *Attorney, Agent, or Firm* — Novick, Kim & Lee PLLC; Jae Youn Kim

(57) ABSTRACT

The purpose of the present invention is to provide a magnetic fluid display in which a magnetic fluid moves in response to a magnetic field and which may display a unique visual image according to the meeting and parting of the magnetic fluid. A magnetic fluid display according to the present invention comprises: a display unit including a transparent liquid into which a magnetic fluid is injected; and a magnetic field generating unit for applying a magnetic field to the magnetic fluid at a rear surface of the display unit. When the magnetic field is applied, the magnetic fluid moves in the transparent liquid in a directional manner, so that an image may be displayed on the display unit.

9 Claims, 8 Drawing Sheets

(56) References Cited

U.S. PATENT DOCUMENTS

| | | | | |
|---|---|---|---|---|
| 6,299,972 | B1 * | 10/2001 | Iwasaki | G09F 9/375 427/508 |
| 6,440,322 | B1 * | 8/2002 | Kim | H01F 1/447 252/62.55 |
| 7,777,137 | B2 | 8/2010 | Ahn et al. | |
| 9,449,744 | B2 | 9/2016 | Lee et al. | |
| 2015/0259570 | A1 * | 9/2015 | Matsuoka | C09D 7/40 524/588 |

FOREIGN PATENT DOCUMENTS

| | | | | |
|---|---|---|---|---|
| CN | 206378614 | U | | 8/2017 |
| JP | 01201293 | A | * | 8/1989 |
| KR | 1020020000683 | A | | 1/2002 |
| KR | 100502115 | B1 | | 7/2005 |
| KR | 1020070093251 | A | | 9/2007 |
| KR | 10-2011-0013544 | A | | 2/2011 |
| KR | 101091206 | B1 | | 12/2011 |
| KR | 101510040 | B1 | | 4/2015 |
| KR | 1020170106872 | | | 9/2017 |
| WO | 2005114316 | A1 | | 12/2005 |

* cited by examiner

MAGNETIC FLUID DISPLAY

CROSS-REFERENCE TO RELATED APPLICATIONS

This application is a Divisional of U.S. application Ser. No. 16/641,643, filed Feb. 24, 2020, which claims priority of National Stage of International Patent Application PCT/KR2018/007023, filed on Jun. 21, 2018, which claims priority of Korean Patent Application No. KR 10-2017-0106872, filed on Aug. 23, 2017, the disclosures of which are incorporated by reference in their entirety.

TECHNICAL FIELD

The present invention relates to a magnetic fluid display. More particularly, the present invention relates to a magnetic fluid display which displays an image by controlling a magnetic fluid of a display unit through a magnetic field applied from a rear surface of the display unit.

BACKGROUND ART

A magnetic fluid is a colloid dispersed solution of magnetic particles each having a size of several nm to several tens nm. The magnetic fluid exhibits a particular feature in which liquidity and magnetization are combined. The magnetic fluid is initially prepared in 1960s at National Aeronautics & Space Administration (NASA) in such a manner that magnetite ore is pulverized by a ball mill, then surfaces of magnetite particles are coated with surfactant, and the coated magnetite particles are dispersed in oils. By using the magnetic fluid prepared as described above, a rocket fuel is magnetized and fluidized to supply the fuel even under a zero-gravity condition.

The magnetic fluid has a particular feature in which separation between a liquid and a solid is not easily generated even when a general centrifugal force or a magnetic field is applied and which behaves as though the liquid itself apparently has a strong magnetic force. Due to the above-described particular feature, the magnetic fluid is used for various fields such as a separation using a specific gravity difference, a magnetic seal, a cooling agent for speakers, magnetic recording media, and a waste oil treatment. However, trials for applying the above feature of the magnetic fluid to a display for indoor and outdoor interiors and designs are insufficient so far.

DISCLOSURE OF THE INVENTION

Technical Problem

The present invention provides a magnetic fluid display capable of displaying an image by using a magnetic fluid to resolve the above-described all sorts of limitations of the related art.

The present invention also provides a magnetic fluid display in which a magnetic fluid moves in response to a magnetic field and which displays a unique visual image according to the meeting and parting of the magnetic fluid.

Technical Solution

An embodiment of the present invention provides a magnetic fluid display including: a display unit including a transparent liquid into which a magnetic fluid is injected; and a magnetic field generating unit for applying a magnetic field from a rear surface of the display unit to the magnetic fluid.

In an embodiment, the display unit may be inclined at a predetermined angle with the ground or vertically stand.

In an embodiment, the magnetic fluid may move in the transparent liquid in a directional manner when the magnetic field is applied, and descend by gravity when the magnetic field is not applied.

In an embodiment, the magnetic fluid may move in the transparent liquid in a directional manner when the magnetic field is applied, so that an image is displayed on the display unit.

In an embodiment, the transparent liquid may be a mixed solution of water and alcohol or ionized water.

In an embodiment, the magnetic fluid may be an oil in which metal oxide particles are dispersed.

In an embodiment, the magnetic fluid may have a specific gravity of 1.2 g/cm$^3$ to 1.5 g/cm$^3$ and a viscosity equal to or less than 2,000 cP.

In an embodiment, an inner wall surface of the display unit containing the transparent liquid may be hydrophilic-coated.

In an embodiment, a surface of the magnetic field generating unit may include a plurality of cells.

In an embodiment, the cells may be patterned, and a patterned shape may correspond to a shape of an image displayed on the display unit.

In an embodiment, the magnetic field generating unit may include a cell moving part that moves the cells on the surface of the magnetic field generating unit to form a pattern.

In an embodiment, each of the cells may have the same or different intensity and frequency of the generated magnetic field.

In an embodiment, each of the cells may have the same or different linear distance to the rear surface of the display unit.

In an embodiment, each of the cells may include at least one of an electromagnet, a permanent magnet, and a coil.

In an embodiment, the magnetic field generating unit may include a first area that applies a magnetic field having an intensity capable of moving the magnetic fluid of the display unit and a second area that applies a magnetic field having an intensity incapable of moving the magnetic fluid.

In an embodiment, the magnetic field generating unit may have one of a cylinder shape, an elliptical cylinder shape, and a belt shape.

In an embodiment, the magnetic field generating unit may be rotatable to change a surface facing the rear surface of the display unit.

In an embodiment, the magnetic field generating unit may further include a speaker part that outputs a sound.

In an embodiment, the speaker part and the magnetic field generating unit may be electrically connected, and at least one of an intensity, a frequency, and a pattern of the magnetic field applied by the magnetic field generating unit to the display unit may be varied according to at least one of a volume and a beat of the sound outputted from the speaker part and an amount of a current flowing through the speaker part.

In an embodiment, the magnetic fluid display may further include a control unit that receives a music signal from the outside and transmits the received music signal to the speaker part to convert the music signal into a magnetic field pattern signal, thereby controlling a shape of the magnetic field applied by the magnetic generating unit to the magnetic fluid.

Advantageous Effects

According to the above-described present invention, there is an effect of realizing the magnetic fluid display capable of displaying an image by using the magnetic fluid.

Also, according to the present invention, there is an effect in which the magnetic fluid moves in response to the magnetic field and which displays a unique visual image according to the meeting and parting of the magnetic fluid.

DESCRIPTION OF SYMBOL

Figure 1:
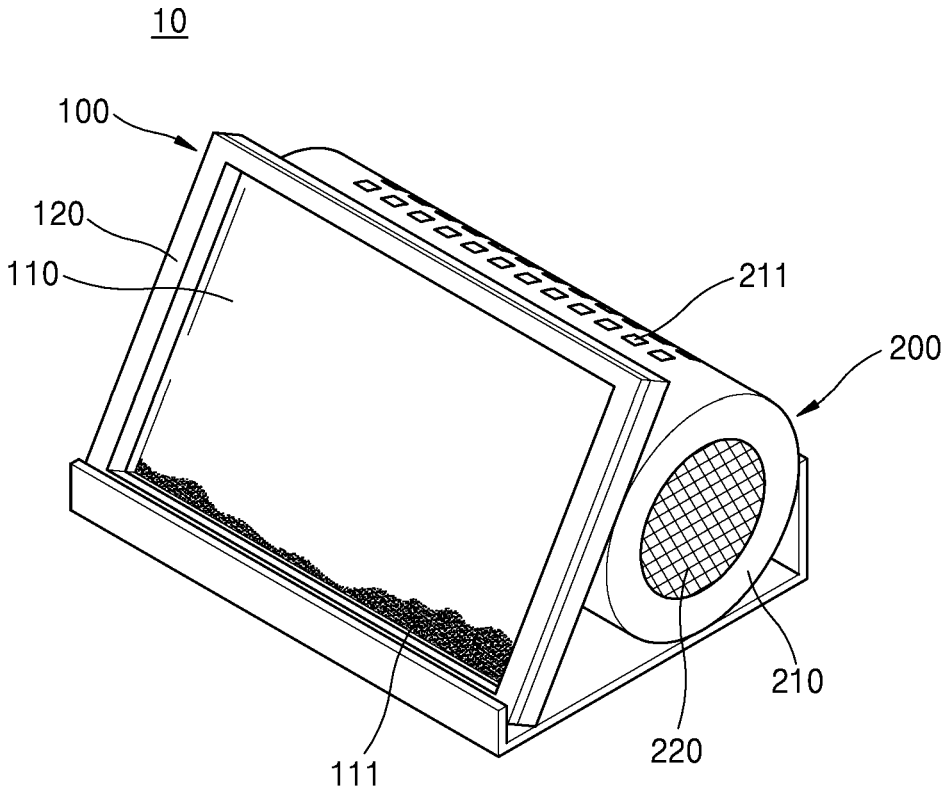
FIG. 1 is a perspective view illustrating a magnetic fluid display according to an embodiment of the present invention.

10: Magnetic fluid display
100: Display unit
110: Display screen
111: Magnetic fluid
120: Frame
200: Magnetic field generating unit
210: Surface of magnetic field generating unit
211: Cell
220: Speaker part
P1~P4: Cell pattern

MODE FOR CARRYING OUT THE INVENTION

Hereinafter, specific embodiments will be described in detail with reference to the accompanying drawings. The embodiments will be described in detail for a person skilled in the art to embody the present invention. The present disclosure may, however, be embodied in different forms and should not be construed as limited to the embodiments set forth herein. Rather, these embodiments are provided so that this disclosure will be thorough and complete, and will fully convey the scope of the inventive concept to those skilled in the art. The description of the present invention is intended to be illustrative, and those with ordinary skill in the technical field of the present invention pertains will be understood that the present invention can be carried out in other specific forms without changing the technical idea or essential features. Further, the scope of the present invention should be defined by the following claims. Like reference numerals in the drawings denote like elements, and thus their description will be omitted. In the drawings, the thicknesses of layers and regions are exaggerated for clarity.

Hereinafter, preferred embodiments will be described in detail with reference to the accompanying drawings so that a person skilled in the technical field of the present invention to easily embody the present invention.

FIG. 1 is a perspective view illustrating a magnetic fluid display 10 according to an embodiment of the present invention.

Referring to FIG. 1, the magnetic fluid display 10 of the present invention may include a display unit 100 and a magnetic field generating unit 200. Although the magnetic fluid display 10 includes the display unit 100 having a plate shape and the magnetic field generating unit 200 having a cylinder shape in FIG. 1, the embodiment of the present invention is not limited thereto.

The display unit 100 may include a display screen 110 on which an image is displayed and a frame 120 around the display screen 110. Here, a term "image" may refer to a shape having a design element such as a shape, symbol, figure, or pattern having an intended message such as a specific design, letter, or mark.

The display screen 110 may include a transparent liquid into which a magnetic fluid 111 is injected. Here, the transparent liquid includes all kinds of liquids having a transmittance so that the liquids may be recognized by being visually compared with the magnetic fluid 111 in addition to a colorless transparent liquid. The transparent liquid may also include a colored transparent liquid and a semitransparent liquid.

The transparent liquid may be inserted and sealed in a tank made of glass or plastic. Thus, the display screen 110 may be a tank or a bottle having a structure in which the transparent liquid is sealed. Alternatively, the display screen 110 may have a structure of sealing the transparent liquid while the display screen 110 is coupled with the frame 210 therearound. In this case, a predetermined sealing member may be further provided to prevent the transparent liquid from being leaked.

The magnetic liquid 111 may be disposed at a lower portion of the display screen 110. The magnetic liquid 111 is a colloid dispersed liquid containing magnetic particles each having a particle size of several nm to several tens nm, i.e., an oil in which metal oxide particles are dispersed. For example, the magnetic fluid 111 may be configured such that magnetite (Fe3O4) particles are dispersed in an organic solvent of oils.

The magnetic fluid 111 may have a particular characteristic in which the solidified metal oxide particles and the liquefied oil are not easily separated and which apparently behaves like a liquid. Thus, the magnetic fluid 111 may move as a separate phase in the transparent liquid instead of being reacted or mixed with the transparent liquid. The magnetic fluid 111 has a distinct color distinguished from the transparent liquid. For example, since the magnetite has an opaque black color, the magnetic fluid 111 may be distinctly distinguished in the transparent liquid, and an image may be recognized through the magnetic fluid 111.

Also, a repulsive force between the magnetic fluid 111 and the transparent liquid is necessarily used for smooth movement of the magnetic fluid 111 in the transparent liquid. When the oil of the magnetic fluid 111 is a nonpolar solvent, the transparent liquid is a polar solvent that is separated therefrom without being dissolved thereto. The transparent liquid may include water and alcohol (ethanol or isopropyl alcohol) or a mixed solution thereof. In addition, the transparent liquid may maximize an electrical repulsive force by using a mixed solution of water and alcohol or an ionized water in which metal ions are dissolved so that a wall surface of the display screen 110 is not stained with the magnetic fluid 111.

The magnetic fluid display 10 of the present invention is characterized to show a unique visual image as the magnetic fluid 111 moves in response to a magnetic field or according to the meeting and parting of the magnetic fluid 111.

The image may be displayed when the magnetic field is applied to the display unit 100, and the image may not be displayed when the application of the magnetic field is released. The image may not be displayed when the magnetic fluid 111 moves to be positioned on at least a corner, an edge, or a side surface. Although the magnetic fluid 111 may move to the corner of the display screen 100 by applying an additional magnetic field, the magnetic fluid 111 may move to the lower portion of the display screen 110 by using gravity in the magnetic fluid display 10 of the present invention.

The display screen 110 may be inclined at a predetermined angle with at least the ground so that the magnetic fluid 111 moves to the lower portion of the display screen 110 using gravity. The display screen 110 may stand perpendicularly to the ground.

Also, the magnetic fluid 111 may sink instead of floating on the transparent liquid to move to the lower portion by gravity. That is, the magnetic fluid 111 may have a specific gravity greater than the transparent liquid. When the transparent liquid is ionized water, the transparent liquid may have a specific gravity of about 1.0 g/cm$^3$, and the magnetic fluid 111 may have a specific gravity greater than that of the transparent liquid. However, when the specific gravity of the magnetic fluid 111 is excessively large, the magnetic fluid 111 may not smoothly move because of a high free fall speed. On the contrary, the specific gravity of the magnetic fluid 111 is excessively small, resistance against the free fall in the transparent liquid increases by buoyancy.

Thus, the magnetic fluid 111 may have a specific gravity of about 1.2 g/cm$^3$ to about 1.5 g/cm3. Since the magnetite has a specific gravity of about 5.18 g/cm$^3$, and the organic solvent oil has a specific gravity of about 0.73 g/cm$^3$ to 1.08 g/cm$^3$ according to materials, the magnetic fluid 111 may have a specific gravity of about 1.2 g/cm$^3$ to about 1.5 g/cm$^3$ by appropriately adjusting a ratio between the metal oxide particles and the oil.

On the other hand, since the magnetic fluid 111 does not smoothly move in the transparent liquid when the magnetic fluid 111 has an excessively large viscosity, the magnetic fluid 111 may have a viscosity equal to or less than 2,000 cP.

Also, since the transparent liquid is a polar solvent, the alcohol used in the mixed solution with the water may be ethanol or isopropyl alcohol. In case of the ionized water, surface tension energy of the magnetic fluid 111 may be varied by pH of the ionized water. The ionized water having neutral pH or acidic pH (about pH 4 to pH 8), at which the surface tension of the magnetic fluid 111 is maintained, may be used so that the magnetic fluid 111 smoothly moves in the transparent liquid.

Figure 9:
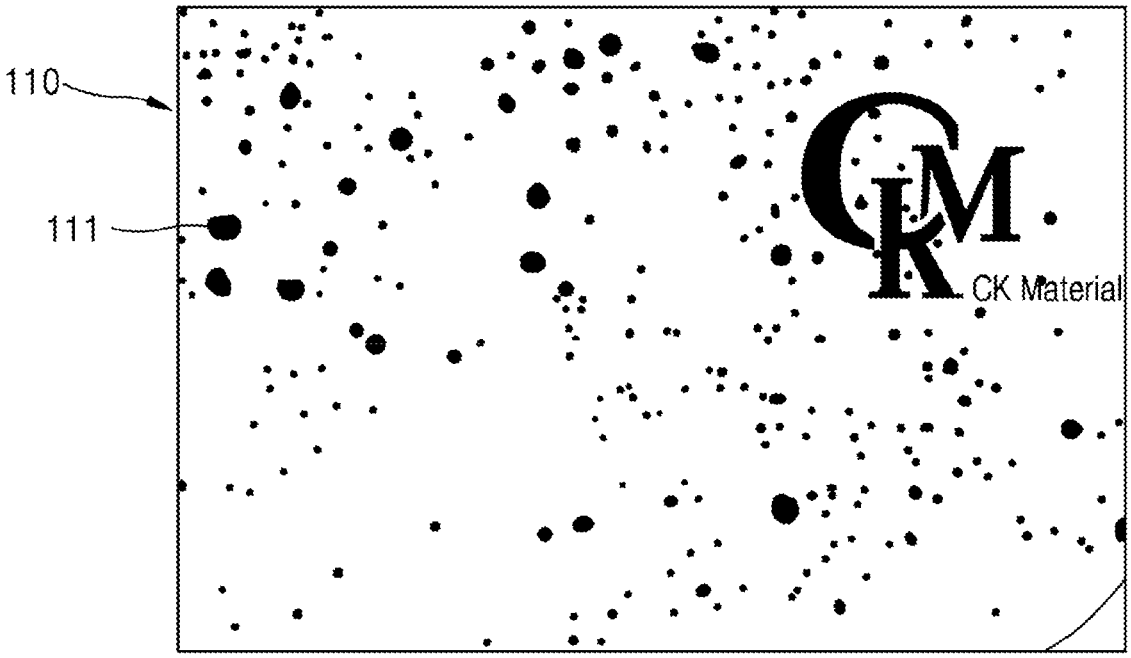
FIG. 9 shows a portion of a display unit according to an embodiment of the present invention.

When the magnetic fluid 111 has an affinity with an inner wall surface of the display unit 100, the magnetic fluid 111 may be adsorbed to the inner wall surface. As illustrated in FIG. 9, when the magnetic fluid 111 is adsorbed to the inner wall surface of the display unit 100, a quality of the image shown in the display screen 110 may be deteriorated. Since the magnetic fluid display 10 is a product maximizing a visual effect, the colored magnetic fluid 111 is required not to be stained to the inner wall surface. Thus, the inner wall surface of the display unit 100 including the transparent liquid may be hydrophilic-coated to prevent the adsorption of the magnetic fluid 111. The hydrophilic-coating of the inner wall surface may be performed through spray coating using a liquefied coating solution in addition to well-known coating methods such as dip coating, spin coating, and plasma coating.

FIG. 2*a*-2*b* are schematic views illustrating the magnetic field generating unit 200 according to an embodiment of the present invention.

Figure 2:
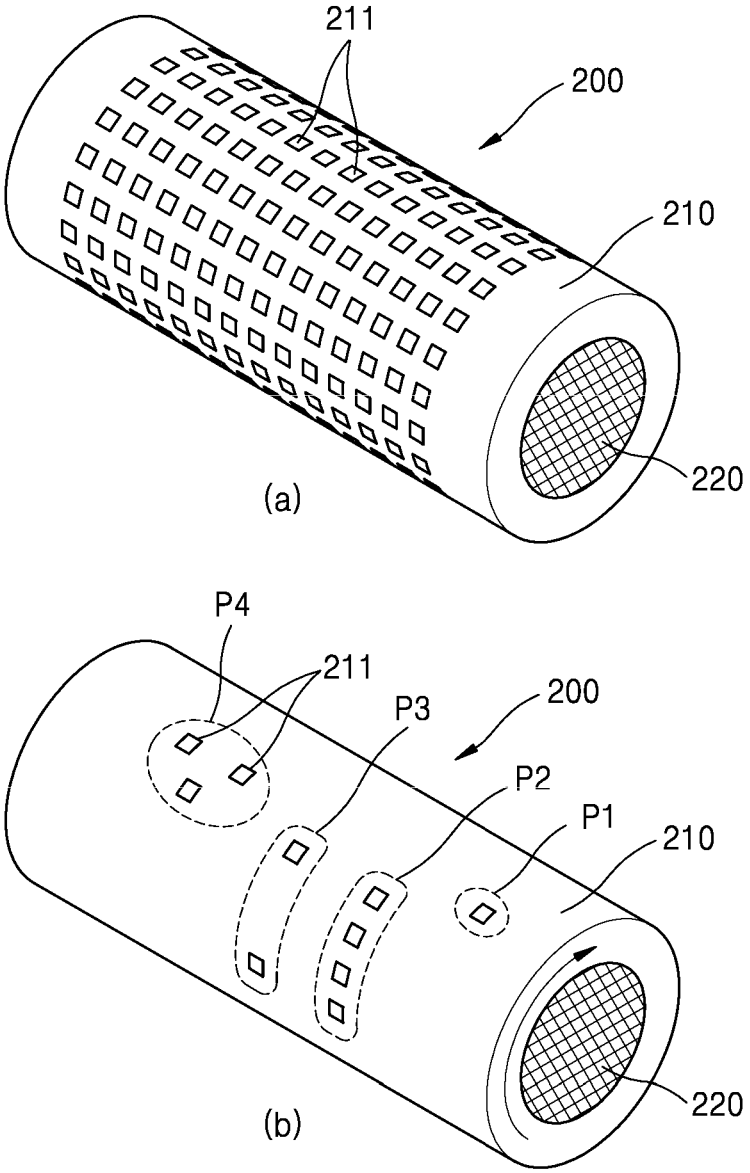
FIG. 2*a*-2*b* are schematic views illustrating a magnetic field generating unit according to an embodiment of the present invention.

Referring to FIGS. 1 and 2, the magnetic field generating unit 200 may be disposed at the rear surface of the display unit 100 and apply a magnetic field to the magnetic fluid 111 of the display unit 100. The magnetic fluid 111 may move according to the magnetic field applied by the magnetic field generating unit 200 in a directional manner, and an image may be realized on the display screen 110 of the display unit 100 by the movement of the magnetic fluid 111. In other words, when the magnetic fluid display 10 operates as the magnetic field generating unit 200 applies the magnetic field, the magnetic fluid 111 may move by the magnetic field to display an image, and when the magnetic fluid display 10 does not operate as the application of the magnetic field is released, the magnetic fluid 111 may move to the lower portion of the display screen 110, and the image may not be displayed.

A plurality of cells 211 may be formed on a surface 210 of the magnetic field generating unit 200. The plurality of cells 211 may be formed with regular arrangement over the entire surface 210 as in (a) of FIG. 2 or patterned (P1 to P4) at a portion of the surface 210 as in (b) of FIG. 2. Each of the cells 211 may generate a magnetic field, and a size of each of the cells 211 may be a factor determining a resolution of the magnetic fluid display 10. Thus, the size of the cell 211 may be varied in consideration of the resolution of the magnetic fluid display 10. Although each of the plurality of cells 211 has an outline on the surface 210 in FIGS. 1 and 2, the cell 211 may be recessed or embedded from the surface 210 not to be seen from the outside.

When the plurality of cells 211 are formed over the entire surface 210 as in (a) of FIG. 2, the magnetic field generating unit 200 may be in a fixed state without rotating. In the fixed state, the magnetic fields generated from the cells 211 may be controlled to have the same or different intensity, frequency, or the like and applied to the magnetic fluid 111.

When the plurality of cells 211 are patterned (P1 to P4) on a portion of the surface 210 as in (b) of FIG. 2, the magnetic field generating unit 200 may rotate. As illustrated in FIGS. 1 and 2, as the magnetic field generating unit 200 rotates clockwise, and the cells 211 moves upward from the lower portion of the screen of the display unit 100, the magnetic fluid 111 may move upward from the lower portion by applying the magnetic field to the magnetic fluid 111 sunk at the lower portion of the display unit 100. While the magnetic field generating unit 200 rotates clockwise, the magnetic field generated from each of the cells 211 may be controlled to have the same or different intensity and frequency and then applied to the magnetic fluid 111.

Each of the cells 211 may include at least one of an electromagnet, a permanent magnet, and a coil, which may generate a magnetic field. The intensity of the magnetic field applied from the rear surface of the display unit 100 is seriously considered. Particularly, when the size of the cell 211 and the resolution of the magnetic fluid display 10 are considered, a permanent magnet capable of applying a magnetic field having a strong intensity concentrated on a narrow area may be preferred, and a mixed type of a permanent magnet, a coil, and an electromagnet may be also used.

Figure 4:
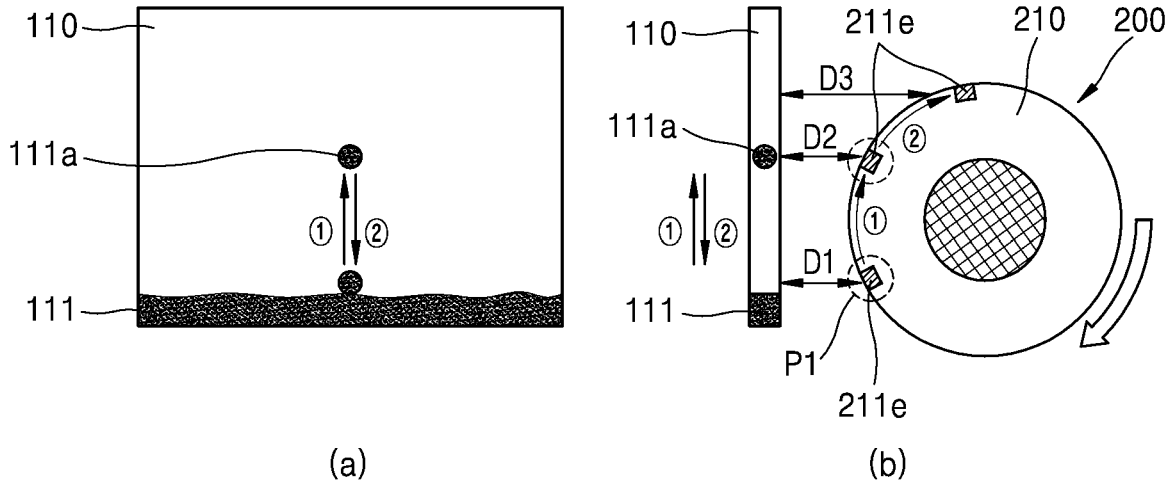

Each of the cells 211 may have the same or different linear distance (D1, D2, D3, . . . ) (see (b) of FIG. 4) to the rear surface of the display unit 100. Since the display unit 100 may have a shape having a curvature instead of a plane shape, a distance to the magnetic field generating unit 200 is defined as the linear distance (D1, D2, D3, . . . ). In a relationship between the intensity of the magnetic field and the magnetic fluid 111, the Coulomb's law [$F \propto q1 \cdot q2/r2$], which represents that the intensity of the magnetic field is inversely proportional to the square of the distance, may be applied.

Each of the cells 211 of the surface 210 of the magnetic field generating unit 200 may have a different distance to the display unit 100. When the intensity of the magnetic field generated from each of the cells 211 is constant, as a result, the intensity of the magnetic field applied to the magnetic fluid 111 is dependent on the distance to the display unit 100. When the distance is D1 and D2 with the magnetic field having the intensity capable of moving the magnetic fluid 111, the magnetic fluid 111 may move in a directional manner. On the other hand, when the distance is D3 with the magnetic field having the intensity incapable of moving the magnetic fluid 111, the magnetic fluid 111 may freely fall by gravity.

From a different viewpoint, the magnetic field generating unit 200 may include a first area that applies a magnetic field having an intensity capable of moving the magnetic fluid 111 and a second area that applies a magnetic field having an intensity incapable of moving the magnetic fluid 111. Each of the cells 211 corresponding to the first area may have a strong intensity of the magnetic field and a short distance to the display unit 100. Each of the cells 211 corresponding to the second area may have a weak intensity of the magnetic field or a state in which the magnetic field is not applied, and a long distance to the display unit 100. When (a) of FIG. 2 is explained as an example, the first area may be an area of the cells 211 each having a distance of about D1 and D2 to the display unit 100, and the second area may be an area of the cells 211 each having a distance of about D3 to the display unit 100. Also, when (b) of FIG. 2 is explained as an example, the first area may be a pattern (P1 to P2) area, and the second area may be the rest area (i.e., an area without the cells 211) except for the pattern (P1 to P4) area.

The magnetic field generating unit 200 may have a shape having a curvature such as a cylinder shape and an elliptical cylinder shape so that the cells 211 have various distances to the display unit 100. Also, the magnetic field generating unit 200 may have a belt shape rotating while the cells 211 are formed thereon. As previously described through (b) of FIG. 2, the magnetic field generating unit 200 may rotate with respect to a predetermined axis so that a surface facing the rear surface of the display unit 100 is real-time changed When the intensity of the magnetic field generated from each of the cells 211 is constant, a predetermined expansion unit may be used to each of the cells 211 to adjust the distance to the display unit 100. In this case, when the expansion unit is expanded to a specific cell 211, the distance to the display unit 100 from the cell 211 may decrease to apply the magnetic field having a further strong intensity.

Also, each of the cells may be installed to be movable instead of being fixed to a specific position on the surface 210 of the magnetic field generating unit 200. To this end, a cell moving part (not shown) moving the cells 211 may be provided on the surface 210 of the magnetic field generating unit 200. The cell moving part (not shown) may include a predetermined guide and rail, which is a movement path of the cells 211, and a motor providing a driving force for moving the cells 211. The plurality of cells 211 may move by the cell moving part, and the moved cells 211 may combine patterns to realize various images.

Referring to FIGS. 1 and 2, the magnetic field generating unit 200 may further include a speaker part 220 for outputting a sound. The magnetic fluid display 10 of the present invention may communicate with the speaker part 220 to generate the magnetic field in the magnetic field generating unit 200 in match with the sound outputted from the speaker part 220.

The speaker part 220 may be electrically connected to the magnetic field generating unit 200, and at least one of the intensity, frequency, and pattern of the magnetic field applied by the magnetic field generating unit 200 to the display unit 100 may be varied according to at least one of a volume and a beat of the sound outputted from the speaker part 220 and an amount of a current flowing through the speaker part 220. Hereinafter, this will be described in more detail.

An external music signal is transmitted to the magnetic fluid display 10 through Bluetooth, an audio jack, etc. To this end, the magnetic fluid display 10 may include a receiving part (not shown) for receiving the music signal. A control part (not shown) may convert the music signal into a digital to analog converter (DAC), an analog digital converter (ADC), etc. Thereafter, the converted signal may be amplified by using a power amplifier or classified into high frequencies, mid frequencies, and low frequencies.

Thereafter, the amplified or classified signal may be converted into a magnetic field pattern signal. The magnetic field pattern signal includes signals related to the intensity and frequency of the magnetic field generated from each of the cells 211 of the magnetic field generating unit 200 and the pattern of the magnetic field generated from the plurality of cells 211. The amplified and classified music signal may be converted into the magnetic field pattern signal in accordance with a pre-stored program conversion rule. Thereafter, a movement pattern of the magnetic fluid 111 may be adjusted by outputting a sound by transmitting the classified music signal to the speaker part 220 and simultaneously controlling each of the cells 211 by transmitting the magnetic field pattern signal to the magnetic field generating unit 200.

For example, when the amount of the current flowing through the speaker part 220 increases, the outputted sound may increase, and the magnetic field pattern signal may be generated in correspondence thereto. The magnetic field pattern signal may allow each of the cells 211 to generate the magnetic field having a strong intensity and simultaneously allow each of the cells 211 to sequentially generate the magnetic field, thereby controlling the magnetic fluid 11 to have a fast movement.

For another example, when the amount of the current flowing through the speaker part 220 is extremely small or disappeared, the outputted sound may decrease or be disappeared, and the magnetic field pattern signal may be generated in correspondence thereto. The magnetic field pattern signal may allow each of the cells 211 not to generate the magnetic field, thereby controlling the magnetic fluid 111 to have a free-fall movement. Due to the freely fallen magnetic fluid 111, the display screen 110 may not realize all sorts of images.

For another example, when the speaker part 220 outputs a regular beat, the magnetic field pattern signal may be generated in correspondence thereto. The magnetic field pattern signal may control the magnetic fluid 111 to have a movement corresponding to the beat by allowing each of the cells 211 to generate or release the magnetic field at a predetermined distance.

As described above, the magnetic fluid display 10 of the present invention may exhibit an effect of delivering rich feelings, in which audio and video are combined, to a user by outputting the sound and simultaneously realizing an image matched with the sound on the display screen 110.

Hereinafter, various embodiments of the magnetic fluid display 10 will be described.

FIGS. 3*a*-3*b*, 4*a*-4*b*, 5*a*-5*b*, 6*a*-6*b* and 7*a*-7*b* are front views and side views illustrating image display shapes of the magnetic fluid display and processes thereof according to an embodiment of the present invention.

Figure 3:
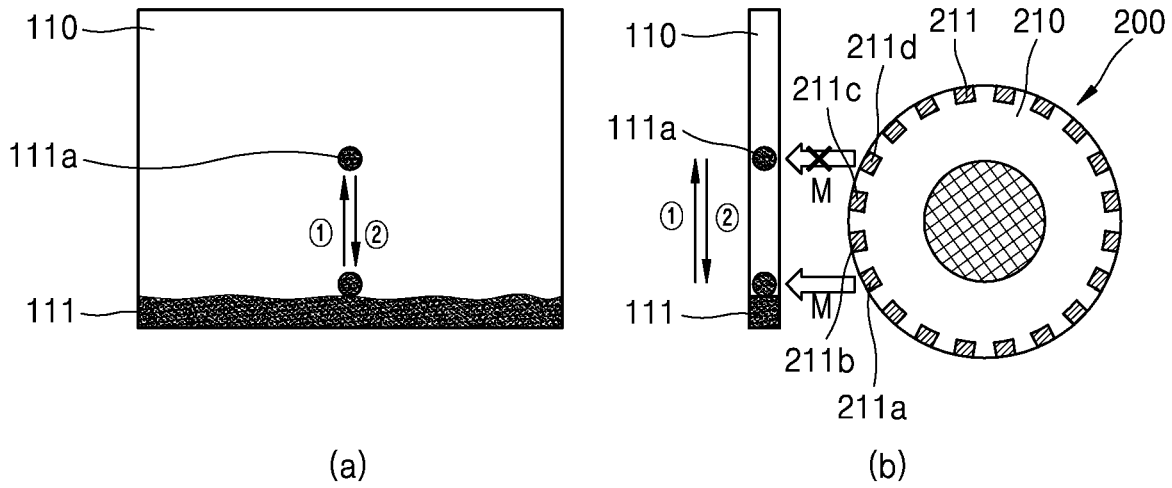
FIGS. 3*a*-3*b*, 4*a*-4*b*, 5*a*-5*b*, 6*a*-6*b* and 7*a*-7*b* are front views and side views illustrating image display shapes of the magnetic fluid display and processes thereof according to an embodiment of the present invention.

FIG. 3 is a view illustrating an embodiment of vertically moving a dot-type magnetic fluid 111*a*. A case when the magnetic field generating unit 200 is fixed without rotating, and the plurality of cells 211 are formed over the entire surface 210 as in (a) of FIG. 2 will be described as an example.

First, a magnetic field M is generated at only a cell 211*a*, and the magnetic field M is not generated at the rest cells 211. A portion 111*a* of the magnetic fluid 111, which is sunk on the bottom, reacts with application of the magnetic field M of the cell 211*a* to move upward. Thereafter, while the magnetic field M is generated from a cell 211*b*, the magnetic field M generated at the cell 211*a* is released at the same time. Thus, the partial magnetic fluid 111*a* may move further upward. Thereafter, as the magnetic field M is generated at a cell 211*c*, and the magnetic field M generated at the cell 211*b* is released at the same time, the magnetic fluid 111*a* may further move upward, and then, when the magnetic field M is generated at a cell 211*d*, and the magnetic field M generated at the cell 211*c* is released at the same time, the magnetic fluid 111*a* may move as much as a height corresponding to the cell 211*d*.

Thereafter, when the magnetic field M generated at the cell 211*d* is released, and the magnetic field M is not generated at the rest cells 211, the magnetic fluid 111*a* is not applied with a magnetic field and freely falls by gravity (path ②).

On the basis of the above-described principle, a dot image, which vertically moves, may be realized. In addition to the vertical movement, when the magnetic field M is sequentially applied to or released from the cells 211 corresponding to a diagonal direction, the magnetic fluid 111*a* may move in the diagonal direction.

FIG. 4 illustrates another embodiment of vertically moving the dot-type magnetic fluid 111*a*. A case when the magnetic field generating unit 200 rotates, and the cell 211 (P1 pattern) is formed on a portion of the surface 210 as in (b) of FIG. 2 will be described as an example. This is a case when only a cell 211*e* is formed in the P1 pattern on the surface of the magnetic field generating unit 200, and a permanent magnet that always generates a constant magnetic field is installed in the cell 211*e*.

While the magnetic field generating unit 200 rotates, the cell 211*e* may enter within a distance D1 capable of moving the magnetic fluid 111*a*. When the cell 211*e* moves upward as the magnetic field generating unit 200 further rotates, the magnetic fluid 111*a* moves upward in correspondence to a height of the cell 211*e* (path ①). The magnetic fluid 111*a* may move together until the cell 211*e* is disposed within a distance D2 capable of moving the magnetic fluid 111*a*.

Thereafter, when the magnetic field generating unit 200 further rotates, and the cell 211*e* is disposed in a distance D3 incapable of moving the magnetic fluid 111*a*, the magnetic fluid 111*a* is not applied with a magnetic field and freely falls by gravity (path ②).

Figure 5:
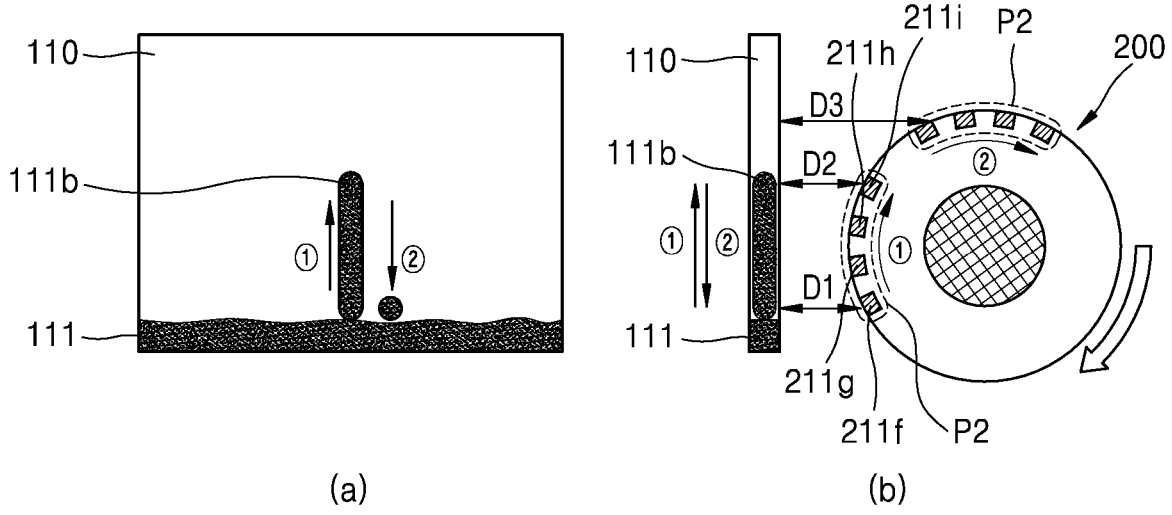

FIG. 5 illustrates an embodiment of realizing a line-type magnetic fluid 111*b*. A case when the magnetic field generating unit 200 rotates, and the cells 211 (P2 pattern) are formed on a portion of the surface 210 as in (b) of FIG. 2 will be described as an example. This is a case when only cells 211*f*, 211*g*, 211*h*, and 211*i* are formed in the P2 pattern on the surface of the magnetic field generating unit 200, and a permanent magnet that always generates a constant magnetic field is installed in the cells 211*f*, 211*g*, 211*h*, and 211*i*.

While the magnetic field generating unit 200 rotates, the cell 211*i* may firstly enter within a distance D1 capable of moving a magnetic fluid 111*b*. When the cell 211*i* moves upward as the magnetic field generating unit 200 further rotates, the magnetic fluid 111*b* also moves upward in correspondence to a height of the cell 211*i*. At the same time, as the magnetic field generating unit 200 rotates, the cells 211*h*, 211*g*, and 211*f* sequentially enter within the distance D1, and the magnetic fluid 111*a* moves upward in correspondence to a height at which each of the cells 211*h*, 211*g*, and 211*f* is disposed (path ①). The magnetic fluid 111*b* may move together until the cells 211*f*, 211*g*, 211*h*, 211*i* are disposed within a distance D2 capable of moving the magnetic fluid 111*b*.

Thereafter, when the magnetic field generating unit 200 further rotates, and the cells 211*f*, 211*g*, 211*h*, 211*i* are disposed in a distance D3 incapable of moving the magnetic fluid 111*b*, the magnetic fluid 111*b* is not applied with a magnetic field and freely falls by gravity (path ②).

Figure 6:
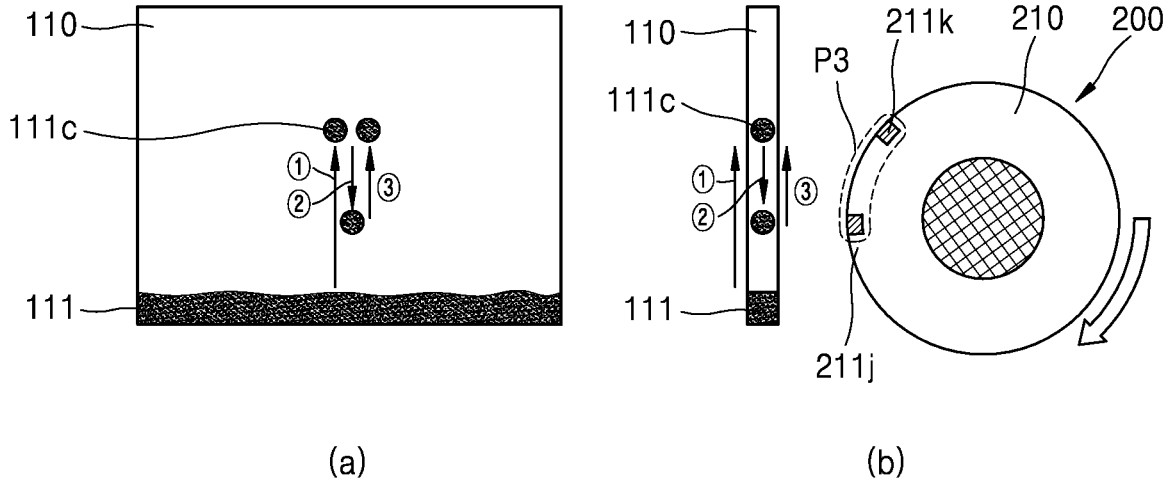

FIG. 6 illustrates an embodiment of moving a dot-type magnetic fluid 111*c*, which is in a free-fall state, in a vertical direction again. A case when the magnetic field generating unit 200 rotates, and the cells 211 (P3 pattern) are formed on a portion of the surface 210 as in (b) of FIG. 2 will be described as an example. This is a case when only cells 211*j* and 211*k* are formed in the P3 pattern on the surface of the magnetic field generating unit 200, an electromagnet or a coil, which arbitrarily generates a magnetic field, is installed in the cell 211*j*, and a permanent magnet that always generates a constant magnetic field is installed in the cell 211*k*.

While the magnetic field generating unit 200 rotates, the cell 211*k*1 may firstly enter within a distance D1 capable of moving a magnetic fluid 111*c*. When the cell 211*k* moves upward as the magnetic field generating unit 200 further rotates, the magnetic fluid 111*c* also moves upward in correspondence to a height of the cell 211*k* (path ①). The magnetic fluid 111*c* may move together until the cells 211*k* is disposed within a distance D2 capable of moving the magnetic fluid 111*c*.

Thereafter, when the magnetic field generating unit 200 further rotates, and the cell 211*k* is disposed in a distance D3 incapable of moving the magnetic fluid 111*c*, the magnetic fluid 111*c* is not applied with a magnetic field and freely falls by gravity (path ②). Until here, this embodiment is the same as the embodiment in FIG. 4.

Thereafter, the magnetic field M is generated at the cell 211*j*. When the magnetic fluid 111*c*, which is a free-fall state, corresponds to the cell 211*j*, the free-fall of the magnetic fluid 111*c* is stopped by the magnetic field M applied from the cell 211*j*, and the magnetic fluid 111*c* moves again in a direction (vertical direction) in which the cell 211*j* moves (path ③).

Figure 7:
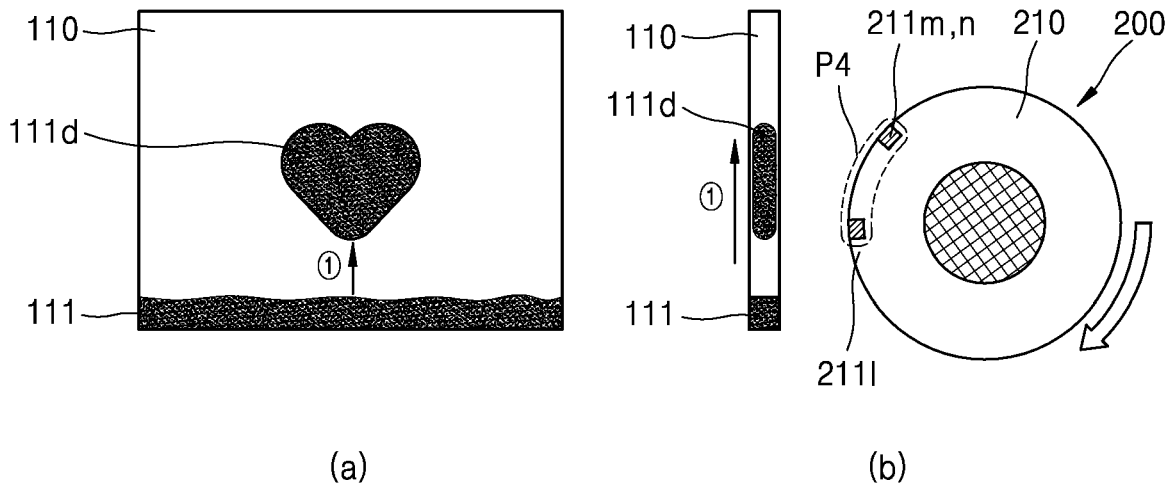

FIG. 7 illustrates an embodiment of realizing a magnetic fluid 111*d* having a heart shape. A case when the magnetic field generating unit 200 rotates, and the cells 211 (P4 pattern) is formed on a portion of the surface 210 as in (b) of FIG. 2 will be described as an example. This is a case when only cells 211*l*, 211*m*, and 211*n* are formed in the P4 pattern on the surface of the magnetic field generating unit 200, and a permanent magnet that always generates a constant magnetic field is installed in the cells 211*l*, 211*m*, and 211*n*.

While the magnetic field generating unit 200 rotates, the cells 211*m* and 211*n* may firstly enter within a distance D1 capable of moving a magnetic fluid 111*d*. When the magnetic field generating unit 200 further rotates, the cell 211*l* also enters with the distance D1 capable of moving a magnetic fluid 111*d*. The cells 211*m* and 211*n* move upward while forming an upper portion of the heart shape of the magnetic fluid 111*d*, and the cell 211*l* moves upward while forming a lower portion of the heart shape (path ①). The above-described patterned shape of the cells may correspond to an image of the magnetic fluid 111*d*.

Besides, when the heart image is realized, as the magnetic field is generated at only the cells 211*m* and 211*n*, which are adjacent in the same line to form two circle shapes (∞), and the magnetic fluid at a central portion flows downward by gravity, the magnetic fluid 111*d* having the heart shape may be realized.

Images such as a dot, a line, a plane, and a figure may be realized on the basis of the principle in FIGS. 3 to 7. Particularly, there is an advantage in that the same image may be repeatedly realized by rotating the magnetic field generating unit 200 when the cells 211 are patterned (P1 to P4) on the surface of the magnetic field generating unit 200. Also, there is an advantage in that a configuration may be simplified because application and release of an additional magnetic field is not required by disposing a permanent magnet in the cell 211. Also, as the magnetic field generating unit 200 is formed into a cartridge type, the magnetic field generating unit 200, in which a different pattern (P1 to P4) is formed, may be replaced, and the image that the user wants may be repeatedly realized.

FIG. 8*a*-8*c* are views illustrating image display shapes of a magnetic fluid display according to other embodiments of the present invention.

In addition to the above-described embodiments in FIGS. 3 to 7, various images may be realized.

Figure 8:
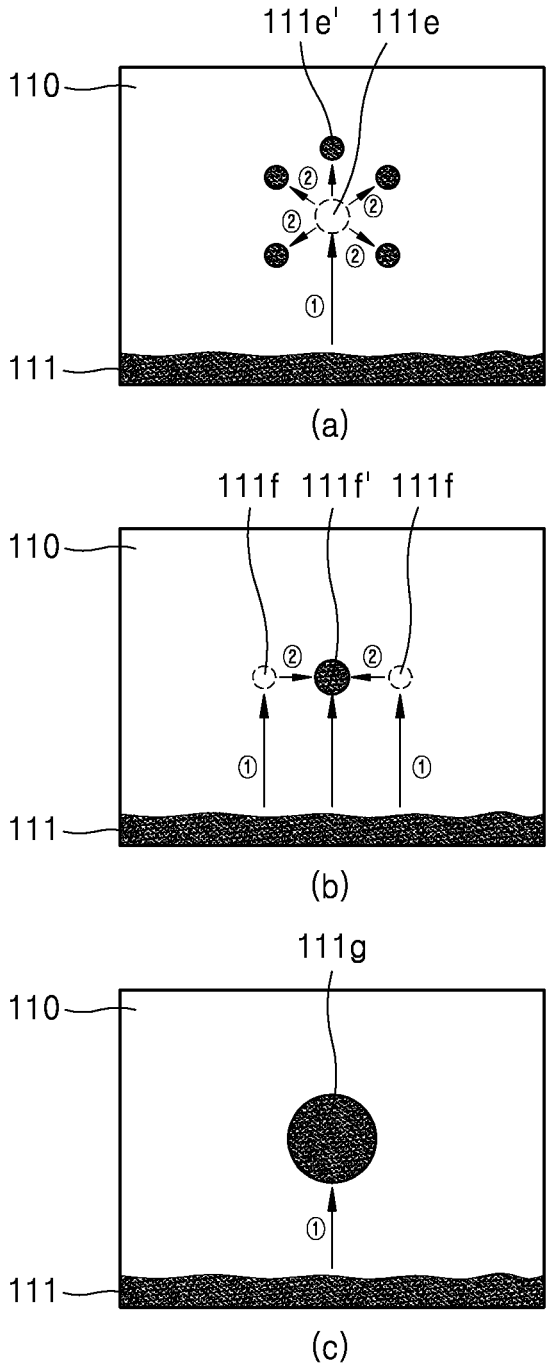
FIG. 8*a*-8*c* are views illustrating image display shapes of a magnetic fluid display according to other embodiments of the present invention.

Referring to (a) of FIG. 8, a dot-type magnetic fluid 111*e* as in FIGS. 3 and 4 moves in a vertical direction (path ①), and then is separated and moves by magnetic fields applied in different directions from the rear surface, a magnetic fluid 111*e*' having a flame or a spike may be realized (path ②).

Referring to (b) of FIG. 8, two dot-type magnetic fluids 111*f* as in FIGS. 3 and 4 move in a vertical direction while being spaced a mutual distance from each other (path ①), and then move in a horizontal direction to be combined with each other, thereby realizing a magnetic fluid 111*f* having a larger dot shape (path ②).

Referring to (c) of FIG. 8, a magnetic fluid 111*g* may not move by one cell 211, and the magnetic fluid 111*g* having a larger circle shape may be realized by a neighboring plurality of cells (path ①).

In addition to the embodiments described through FIGS. 3 to 8, the magnetic fluid 111 may realize various figures such as a spike shape, a sphere shape, a non-sphere shape, a cone shape, a tadpole shape, and a fountain shape and various signs such as a boomerang sign, V, W, A, and AA.

In case of the embodiments described in FIGS. 3 to 8, although the cells 211 fixed on the surface of the magnetic field generating unit 200 that is in a fixed or rotating state are exemplarily described, the embodiments may be equally realized in a case when the cells 211 are movable instead of being fixed at a specific position on the surface 210 of the magnetic field generating unit 200.

FIG. 9 shows a portion of the display unit according to an embodiment of the present invention.

Referring to FIG. 9, it may be checked that the magnetic fluids 111 injected into the transparent liquid of the display screen 110 is visually contrasted with the transparent liquid to form an image. Here, since the magnetic fluid 111 may be adsorbed to the inner wall surface of the display unit 100 and pollute the display screen 110, the inner wall surface of the display unit 100 may be hydrophilic-coated to prevent the adsorption of the magnetic fluid 111.

Figure 10:
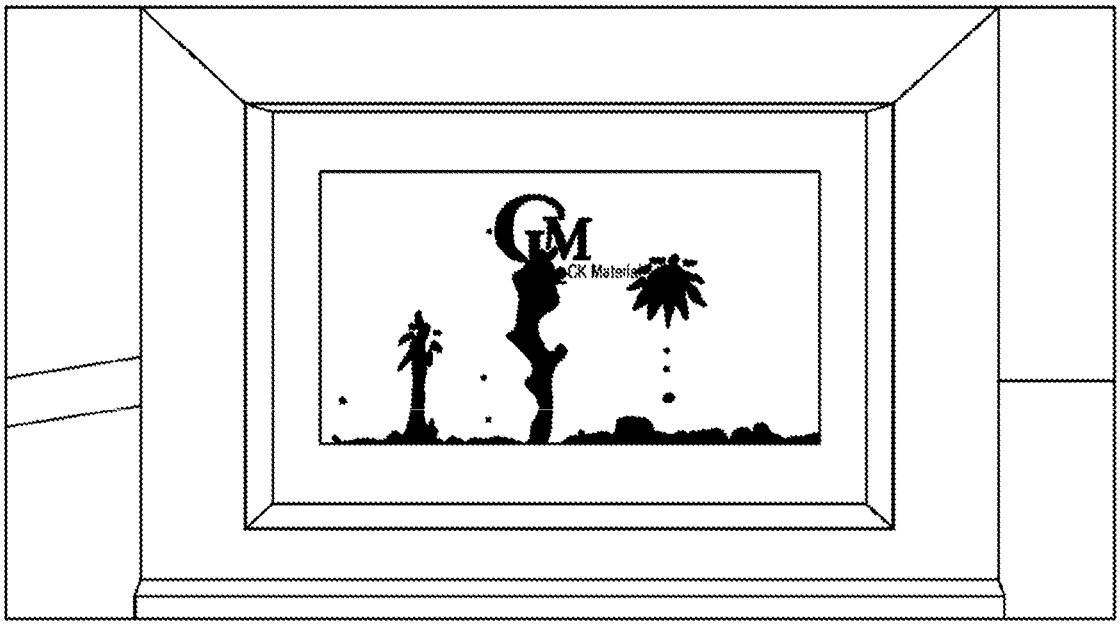
FIGS. 10 and 11 show images displayed in the display unit according to an embodiment of the present invention.
Figure 11:
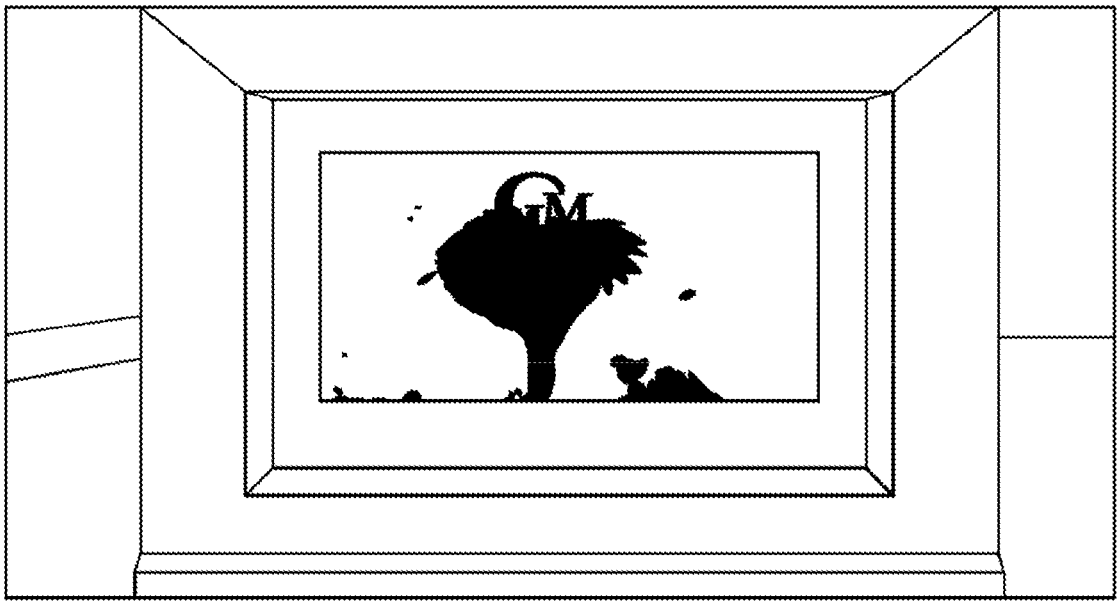

FIGS. 10 and 11 show images displayed in the display unit 100 according to an embodiment of the present invention.

Referring to FIG. 10, an image obtained by coupling the vertically formed line-type magnetic fluid 111*b* (see FIG. 5) with the magnetic fluid 111*e*' (see (a) of FIG. 8) spreading in the form of a flame or a spike at the upper portion may be shown. Also, referring to FIG. 11, an image of the magnetic fluid 111*d* (see FIG. 7) having the heart shape may be shown.

As described above, the magnetic fluid display 10 of the present invention may exhibit an image by using the magnetic fluid 111, and have an effect of realizing various images by controlling the shape of the magnetic field applied to the magnetic fluid 111.

Also, the present invention may display a unique visual image according to the meeting and parting of the magnetic fluid 111, and have an effect of delivering a complex feeling, in which audio and video are combined, to a user such that the magnetic fluid 111 realizes an image in match with the sound outputted through the speaker part 220.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed. Accordingly, the present invention embraces all such alternative modifications and variations as fall within the spirit and scope of the appended claims.

The invention claimed is:

1. A display comprising:

a display unit comprising a fluid that contains magnetic particles; and a magnetic field generating unit for applying a magnetic field to the display unit, wherein the magnetic field generating unit comprises a plurality of cells, and each cell sequentially generates a magnetic field having an intensity capable of moving the magnetic particles of the display unit.

2. The display of claim 1, further comprising:

a speaker part that outputs a sound.

3. The display of claim 2, wherein at least one of an intensity, a frequency, and a pattern of the magnetic field applied by the magnetic field generating unit to the display unit varies according to at least one of a volume and a beat of the sound outputted from the speaker part.

4. The display of claim 1, wherein each of the cells generates a magnetic field having the same or different intensity and frequency.

5. The display of claim 1, wherein each of the cells has the same or different linear distance to the display unit.

6. The display of claim 1, wherein the magnetic particles move in a directional manner when the magnetic field is applied, and descend by gravity when the magnetic field is not applied.

7. A display comprising:

a display unit comprising a fluid that contains magnetic particles;

a magnetic field generating unit for applying a magnetic field to the display unit; and a speaker part that outputs a sound, wherein the magnetic field generating unit comprises an area that applies a magnetic field having an intensity capable of moving the magnetic particles of the display unit, and wherein the area changes with time.

8. The display of claim 7, wherein at least one of an intensity, a frequency, and a pattern of the magnetic field applied by the magnetic field generating unit to the display unit varies according to at least one of a volume and a beat of the sound outputted from the speaker part.

9. The display of claim 7, wherein the magnetic particles move in a directional manner when the magnetic field is applied, and descend by gravity when the magnetic field is not applied.

* * * * *